US008602921B2

(12) United States Patent
Román

(10) Patent No.: US 8,602,921 B2
(45) Date of Patent: Dec. 10, 2013

(54) LIGHTWEIGHT PORTABLE GOAL POST

(76) Inventor: Kendyl A. Román, Sunnyvale, CA (US)

( * ) Notice: Subject to any disclaimer, the term of this patent is extended or adjusted under 35 U.S.C. 154(b) by 254 days.

(21) Appl. No.: 13/205,555

(22) Filed: Aug. 8, 2011

(65) Prior Publication Data

US 2011/0294611 A1 Dec. 1, 2011

Related U.S. Application Data

(63) Continuation-in-part of application No. 12/321,268, filed on Jan. 16, 2009, now abandoned.

(51) Int. Cl.
*A63B 63/00* (2006.01)

(52) U.S. Cl.
USPC ..... 473/477; 273/402

(58) Field of Classification Search
USPC ..... 273/398–402; 473/476–478; 403/295; 138/115, 174; 428/36.9; 52/834, 852
See application file for complete search history.

(56) References Cited

U.S. PATENT DOCUMENTS

| | | | | | |
|---|---|---|---|---|---|
| 1,677,714 | A * | 7/1928 | Frease | 138/115 |
| 3,908,992 | A * | 9/1975 | Cunningham et al. | 473/477 |
| 5,083,882 | A * | 1/1992 | Liu | 403/297 |
| 5,102,254 | A * | 4/1992 | Yeh | 403/174 |
| 5,249,796 | A * | 10/1993 | Silvi | 473/416 |
| 5,316,314 | A * | 5/1994 | Wilson | 273/400 |
| 5,409,122 | A * | 4/1995 | Lazarus | 211/186 |
| 5,564,711 | A * | 10/1996 | Scheie | 273/400 |
| 5,580,064 | A * | 12/1996 | Childers, Jr. | 273/400 |
| 5,599,024 | A * | 2/1997 | Acuff et al. | 473/478 |
| 5,842,939 | A * | 12/1998 | Pui et al. | 473/478 |
| 6,024,659 | A * | 2/2000 | Reed | 473/477 |
| 6,371,873 | B1 * | 4/2002 | Wang | 473/478 |
| 6,752,729 | B1 * | 6/2004 | Huang | 473/476 |
| 6,893,364 | B1 * | 5/2005 | Grunfeld | 473/446 |
| 6,899,645 | B1 * | 5/2005 | Hsiao | 473/446 |
| 7,074,141 | B2 * | 7/2006 | Bryant et al. | 473/478 |
| 7,090,596 | B2 * | 8/2006 | David | 473/439 |
| 7,300,059 | B2 * | 11/2007 | Caruso | 273/400 |
| 7,351,168 | B1 * | 4/2008 | Pannell | 473/476 |
| 2004/0219999 | A1 * | 11/2004 | Oister et al. | 473/478 |
| 2005/0008431 | A1 * | 1/2005 | Albaugh | 403/297 |
| 2005/0062231 | A1 * | 3/2005 | Oister et al. | 273/407 |
| 2006/0226607 | A1 * | 10/2006 | Chen | 273/407 |

* cited by examiner

*Primary Examiner* — Mark Graham

(57) ABSTRACT

Low cost, durable, reusable, lightweight, inexpensive, simple, easy to assemble/disassemble, transportable goal posts. Each goal posts may be composed of single piece T reinforcements and a single piece cross bar reinforcement, as well as readily available construction materials, such as PVC pipe. The bodies of the single piece reinforcements are sized so that the pipes forming the upright posts and crossbar have the same length. Assembly, disassembly, and transportation are simplified. The disassembled components can be carried in vans and SUVs. Internal reinforcements allow flexible, low cost materials such as PVC pipe to be used while maintaining a professional, aesthetic appearance.

16 Claims, 6 Drawing Sheets

LIGHTWEIGHT PORTABLE GOAL POST

RELATED APPLICATIONS

This application is a continuation-in-part of co-pending U.S. patent application Ser. No. 12/321,268, filed Jan. 16, 2009 now abandoned. This application claims priority based on the parent application.

BACKGROUND

1. Field of the Invention

The present invention relates to goal posts used on sport fields, in particular the invention related to improved lightweight, portable, low cost goal posts.

2. Description of Prior Art

Rugby Football is becoming more popular in the United States and other countries. However, with a few notable exceptions such as Stanford, U.C. Berkeley and West Point there are few permanent Rugby Football Stadiums. Fields used for Rugby are typically used for soccer, baseball and other sports that require the Rugby goal posts to be removed after the match or tournament is concluded. Further, Rugby typically is a club sport and the clubs have limited resources and need to play in different fields.

For many years, Rugby Football has been played all over the world. However, the sport has been more popular in countries other than the United States, making Rugby Football fields scarce. American Football and Association Football (soccer) fields, on the other hand, are everywhere. Having the ability to erect a low cost, portable Rugby goal post would make it easier to play Rugby on any suitable pitch.

In the case of Rugby Union, the International Rugby Board (IRB) sets the specification for the size and shape of the regulation Rugby goal posts. Currently the goal post must be at least 3.4 meters high with the cross bar being 3.0 meters high and 5.6 meters wide (between the upright posts).

Previously, single piece goal posts have been manufactured of rectangular or round (tubular) metal. However, these are heavy, expensive, and difficult to transport. Some versions have a removable cross bar, but are still difficult to transport because they don't fit in a passenger vehicle and are relatively difficult to breakdown and reassemble.

What is needed is a lightweight, low cost, portable Rugby goal post that can be broken down, placed inside commonly available vans and SUVs and reassembled.

SUMMARY OF THE INVENTION

It is an objective of the present invention to provide an improved goal post having various advantages that make for quick and easy setup and ultimately facilitate the playing of Rugby on any suitably sized sports field. The various embodiments include novel, lightweight, strong, low cost manufacture, easy to setup, easy to store, easy to transport goal posts.

OBJECTS AND ADVANTAGES

Some objects and advantages of the present invention are:

a) To provide an inexpensive goal post.
b) To provide a simpler way of making a goal post.
c) To provide a collapsible goal post.
d) To provide an easy to store goal post.
e) To provide an easy to transport goal post.
f) To provide a lightweight goal post.
g) To provide a simple way to manufacture goal posts.

h) To provide an inexpensive way to manufacture goal posts.
i) To provide a simple way to ship goal posts components.
j) To provide an ideal goal post for people, groups of people, and organizations, such as athletic clubs, schools and churches, who prefer a low maintenance and low cost goal post.
k) To provide a goal post that could be sold in kits to be assembled by the purchaser and doesn't require special tools such as wrenches, pliers, and screwdrivers.
l) To provide a goal post made of PVC pipe and or other types of rods, pipes, and tubing that are plastic, metal etc. and which are inexpensive and readily available.
m) To provide a goal post made of parts with consistent sizes to minimize manufacturing and make it easier to assemble.
n) To provide a goal post having a professional and aesthetic appearance with hidden seams between the components.

DRAWING FIGURES

In the drawings, closely related figures have the same number but different alphabetic suffixes.

REFERENCE NUMERALS IN DRAWINGS

Figure 1:
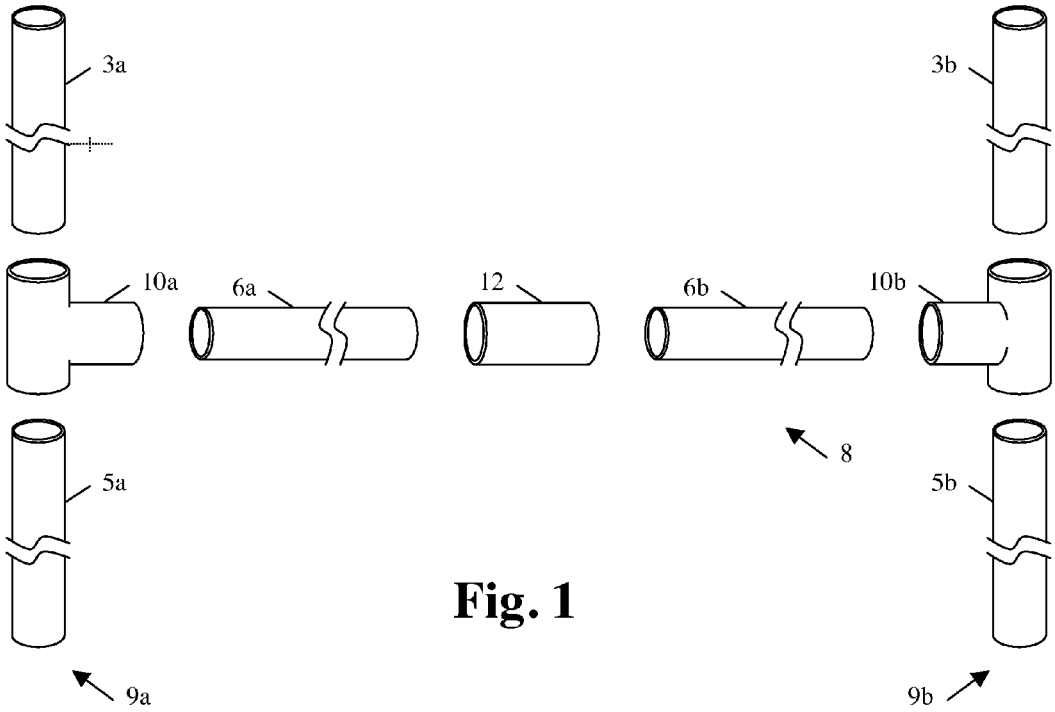
FIG. 1 illustrates a PVC pipe version of a Rugby goal post.

| | |
|---|---|
| 1 (a-b) | T reinforcement |
| 2 | cross bar reinforcement |
| 3 (a-b) | upper post |
| 4 (a-b) | cap |
| 5 (a-b) | lower post |
| 6 (a-b) | cross bar section |
| 7 (a-b) | fence post |
| 8 | cross bar |
| 9 (a-b) | post |
| 10 (a-b) | T connector |
| 11 | goal post |
| 12 | straight connector |
| 20 (a-b) | T connector with screw entry |
| 22 (a-b) | vertical board |
| 24 (a-b) | horizontal board |
| 26 (a-b) | screw |
| 28 (a-b) | washer |
| 30 | vertical board screw hole |
| 32 | horizontal board screw hole |
| 34 | connector screw entry |
| 36 | center horizontal board |
| 60 (a-c) | leg |
| 63 (a-e) | leg shoulder |
| 66 (a-e) | leg reinforcement |
| 69 | T body |
| 70 (a-b) | cross bar leg |
| 71 | first alternate leg |
| 72 | second alternate leg |

-continued

| REFERENCE NUMERALS IN DRAWINGS | |
|---|---|
| 73 | third alternate leg |
| 74 | fourth alternate leg |
| 75 | cutout |
| 79 | cross bar body |
| 80 | cap with wind streamer attachment |
| 81 | wind streamer |
| 82 | wind streamer attachment |
| 84 | cap shoulder |

DESCRIPTION OF THE INVENTION

PVC Pipes and Connectors Solution

FIG. 1 illustrates an early attempt to solve the above described problems was to make portable goal posts out of commercially available PVC pipes and standard connectors (FIG. 1). T connectors 10*a* and 10*b* are connected onto upper posts 3*a* and 3*b*, lower posts 5*a* and 5*b* forming posts 9*a* and 9*b*. Cross bar sections 6*a* and 6*b* are connected into the T connectors 10*a* and 10*b* respectively and into a straight connector 12 forming a cross bar 8.

Figure 2:
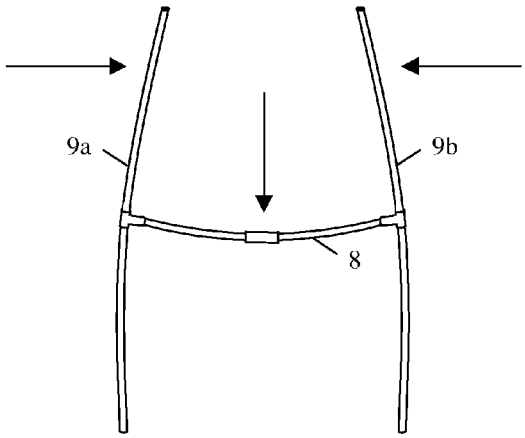
FIG. 2 illustrates PVC posts leaning in due to sagging PVC cross bar.

Testing showed that this PVC-only goal post met some of the requirements but was not a complete solution. PVC pipe is relative flexible. As illustrated by FIG. 2, the weight of the cross bar 8 caused cross bar 8 to sag and the posts 9*a* and 9*b* to lean inward. This PVC-only solution could be challenged because did not meet regulation shape and brought ridicule to the home team.

To meet regulation size while using standard connectors, the upper posts 3, lower posts 5 and cross bar sections 6 are cut to different lengths, for example some are cut to nine feet while the others are cut to nine feet ten inches. This difference in size makes it difficult to quickly assemble the pipes in the right configuration.

In one embodiment, the PVC pipes were cut from six 2" by 20' PVC pipes and assembled with 2" Tees, Cap, Connectors.

PVC Pipes with Wooden Reinforcements

Figure 3:
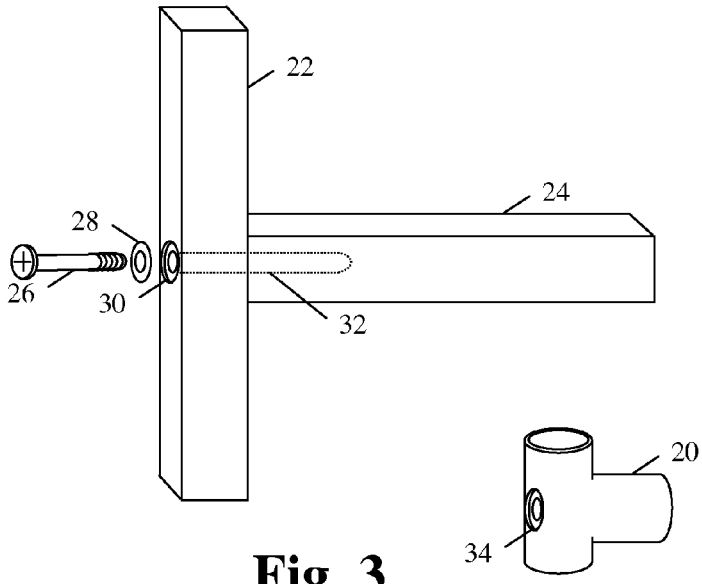
FIGS. 3 and 4 illustrate a solution with wooden reinforcements.
Figure 4:
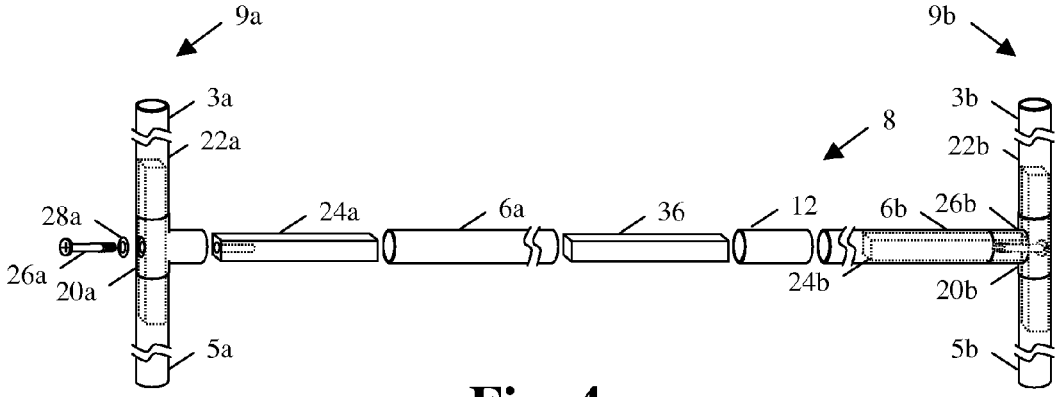

FIGS. 3 and 4 illustrate how the PVC-only solution was improved by using wooden reinforcements inside the cross bar and inside the T connections.

FIG. 3 illustrates the details of the wooden reinforcement comprising vertical board 22 and horizontal board 24. A screw 26 is inserted through washer 28 into a vertical board screw hole 30 and tightened to hold the vertical board 22 and the horizontal board 24 together. In order to attach the board together inside the PVC pipes, the standard T connector is replaced with a T connector with screw entry 20, which has a connector screw entry 34, which allows access to insert the screw 26, and a wrench (not shown).

FIG. 4 illustrates a reinforced PVC pipe goal post. The vertical boards 22*a* and 22*b*, the horizontal boards 24*a* and 24*b* and the center horizontal board 36 are placed inside PVC posts (3*a*, 3*b*, 5*a*, 5*b*, 6*a* and 6*b*) and T connector with screw entries (20*a* and 20*b*). After the boards are inside the PVC components, the PVC pipes are inserted into the connectors. Optionally, a center horizontal board 36 is also placed inside the PVC cross bar sections (6*a* and 6*b*) and straight connector 12 to further reduce the sag in the cross bar 8.

The T connectors with screw entry 20*a* and 20*b* are connected onto the upper posts 3*a* and 3*b*, the lower posts 5*a* and 5*b* forming the posts 9*a* and 9*b*. The cross bar sections 6*a* and 6*b* are connected into the T connector with screw entry 20*a* and 20*b* respectively and into the straight connector 12 forming the cross bar 8. The center horizontal board 36 is placed inside the straight connector 12 prior to it being connected to cross bar sections 6*a* and 6*b*.

The screw 26 and washer 28 are inserted through the connector screw entry 34 of the T connector with screw entry 20, into the vertical board screw hole 30 and threaded into horizontal board screw hole 32 to hold the vertical board 22 and the horizontal board 24 together. The outer PVC pipes are reinforced by the inner boards.

In one embodiment, the board are made from 2"×2"×2" redwood cut into one 5' and one 3' length, respectively.

Testing showed good results as far as the shape of the goal posts, but there are still problems.

The screw 26 joint into the horizontal board 24 at the horizontal board screw hole 32 is weak and doesn't hold up over a few uses. Alternative embodiments attempt to improve this by using bolts that attach to nuts embedded in the horizontal board 24, or use different hardware, but these embodiments still have the following problems in common with the previous disclosure.

Because the details of the complex reinforcement mechanism is hidden, in testing the wooden boards (22, 24) were innocently broken by volunteers helping to take this wood reinforced goal post down.

There are many parts and it is difficult to assemble and requires special tools such as wrenches, pliers, and screwdrivers. It's hard to keep track of the tools while carrying the PVC pipes and parts from the vehicle and across the fields. The screw is difficult to put in place and easy to lose on the playing field. Once lost, a large screw presents a hazard for injury.

The assembled poles 9*a* and 9*b* and the crossbar 8 have irregular shapes because the T connectors 20 and straight connector 12 have circumferences larger than the PVC pipes (for example see outline of FIG. 2).

Portable Goal Post with Single Piece Reinforcements

Figure 5:
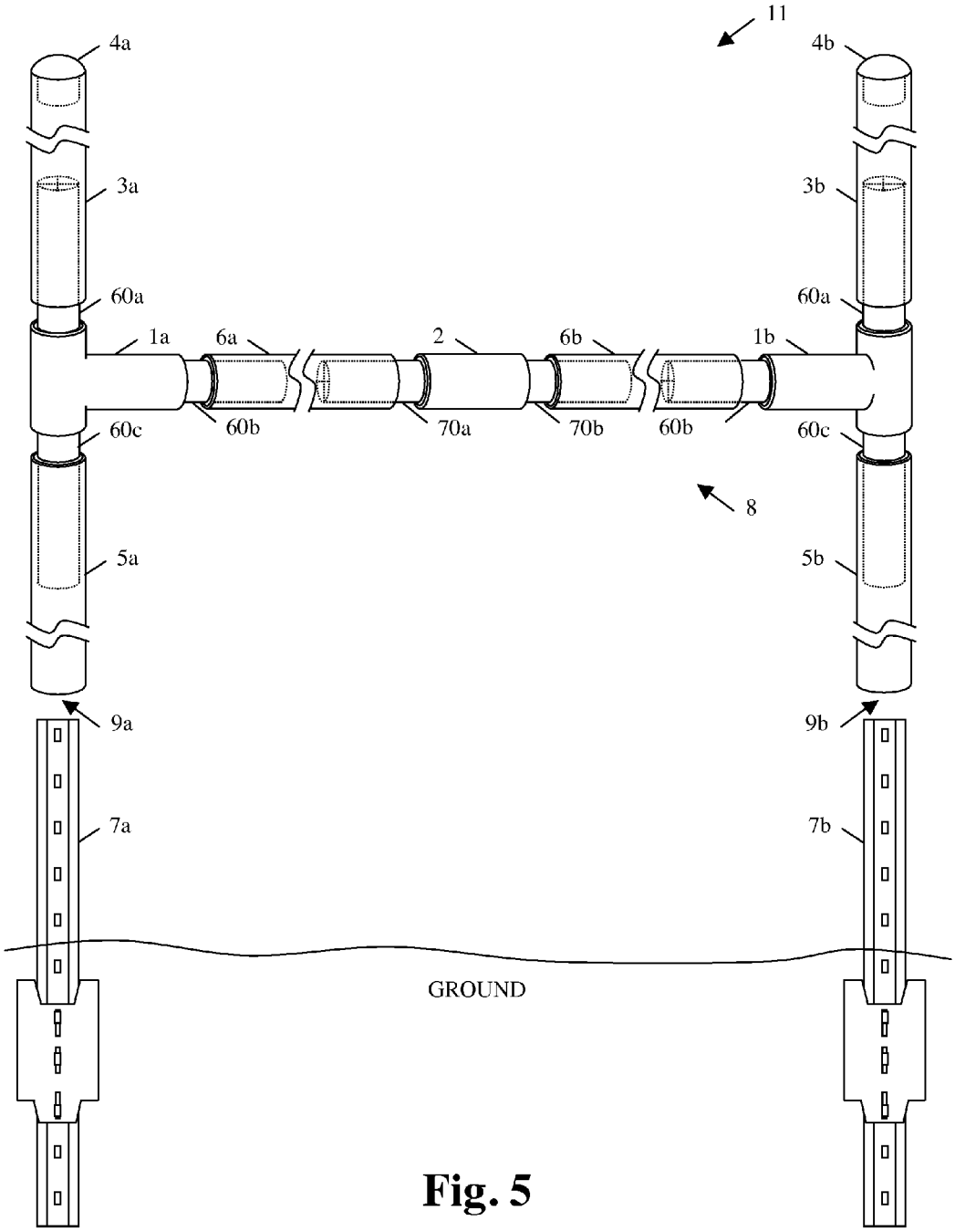
FIG. 5 illustrates a solution with single piece reinforcements.

FIG. 5 shows goal post 11, which uses single piece reinforcements (1, 2) that are made of lightweight but strong material such as plastic or metal. Reinforcements are not the same as conventional connectors. Conventional connectors only connect pipes but fail to provide a substantial reinforcement function. These reinforcements while providing a connecting function also provide an important additional function of reinforcing the pipes. The reinforcement legs are a significant length compared to the lengths of the pipes that they reinforce. The single piece reinforcements are preferably manufactured through a molding process, but some embodiments may be homemade using commercially available materials. In one embodiment the pipes are standard PVC pipes cut to the same length. The pipes including the upper posts 3*a* and 3*b*, lower posts 5*a* and 5*b*, and cross bar sections 6*a* and 6*b* are connected onto the T reinforcements 1*a* and 1*b*. The upper posts 3*a* and 3*b* are connected onto legs 60*a* (of 1*a* and 1*b* respectively), and the lower posts 5*a* and 5*b* are connected onto legs 60*c* (of 1*a* and 1*b* respectively), forming the posts 9*a* and 9*b*. The cross bar section 6*a* is connected onto leg 60*b* of T reinforcements 1*a* and the cross bar leg 70*a* of the cross bar reinforcement 2, and the cross bar section 6*b* is connected onto leg 60*b* of T reinforcements 1*a* cross bar leg 70*b* of the cross bar reinforcement 2 forming the cross bar 8.

This assembly requires no tools. For each goal post, in a pair of goal posts, there are only three components (1*a*, 1*b*, and 2) needed to connect the pipes. The parts are easy to carry, hard to lose, hard to break. The pieces are intuitive and easy to assemble and disassemble.

In an embodiment where the pipes (3*a*, 3*b*, 5*a*, 5*b*, 6*a*, and 6*b*) are cut to the same length, the length of the respective bodies (69 and 79) are made so that the regardless of which pipe is used, the resulting goal post 11 will be regulation size and shape (see discussion regarding preferred embodiments in reference to FIG. 9A and FIG. 9B below).

Once assembled, the goal post 11 is held up, for example, by placing the lower posts 5*a* and 5*b* over standard steel fence posts 7*a* and 7*b* that are driven into the ground.

In one embodiment the tops of the upper posts 3*a* and 3*b* are left open.

In yet other embodiments the tops of the upper posts 3*a* and 3*b* are closed with caps 4*a* and 4*b* (FIG. 8A) or with caps with wind streamer attachments 80 (FIG. 8B), respectively.

The assembled goal post 11 is lightweight, has a smooth outer consistent diameter, and performs well despite the substantially lower cost of PVC pipe. The goal post 11 can be assembled and disassembled without tools or loose parts. The assembly and disassembly is intuitive and is simpler and faster. The disassembled goal post 11 can fit in most passenger vehicles including station wagons and sedans with fold out seats.

Embodiments of Single Piece Reinforcements

Figure 6:
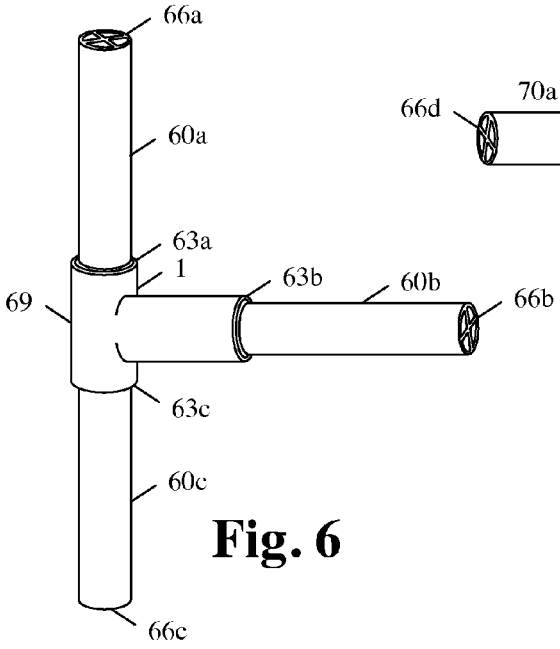
FIG. 6 illustrates a T reinforcement.
Figure 7A:
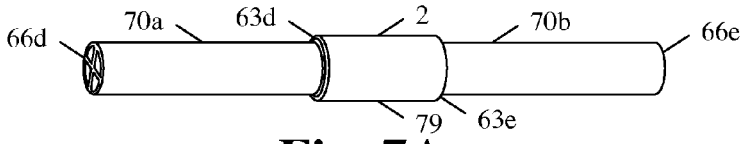
FIG. 7A through 7E illustrates the embodiments of reinforcement legs.

Details of one embodiment of molded pieces are shown in FIG. 6, namely the T reinforcement 1, and in FIG. 7A, namely the cross bar reinforcement 2. The body of each T body 69 and cross bar reinforcement body 79 preferably has the same outer diameter as the PVC pipes including the upper posts 3*a* and 3*b*, lower posts 5*a* and 5*b* and cross bar sections 6*a* and 6*b*. The reinforcement legs 60(*a-c*) and cross bar legs 70(*a-b*) have an outer diameter that fits tightly the inner diameter of the PVC pipes (3*a*, 3*b*, 5*a*, 5*b*, 6*a*, & 6*b*). The T body 69 and the cross bar reinforcement body 79 leg shoulders 63(*a-e*) that match the end of each PVC pipe (3*a*, 3*b*, 5*a*, 5*b*, 6*a*, & 6*b*) when fully inserted (forming a hidden seam) providing the consistent outer diameter for the goal post 11.

FIG. 6 illustrates one embodiment of the T reinforcement 1, comprising a T body 69 and three legs (60*a*, 60*b*, and 60*c*). Where the respective legs connect to the T body 69, the T reinforcement 1 comprises a leg shoulder (63*a*, 63*b*, and 63*c*, respectively).

FIG. 7A illustrates one embodiment of the cross bar reinforcement 2, comprising a cross bar body 79 and two cross bar legs (70*a*, and 70*b*). Where the respective legs connect to the cross bar body 79, the cross bar reinforcement 2 comprises a leg shoulder (63*d* and 63*e*, respectively).

Good results have been obtained where each of the legs are greater than two feet in length. The legs reinforce the respective pipes providing greater structural strength and help maintain the desired goal post shape enabling the use of low cost, lightweight, relatively flexible materials for the pipes, such as for example two inch PVC pipe.

As discussed above, optionally, when the T body 69 and cross bar body 79 have sufficient predetermined length the pipes (3*a*, 3*b*, 5*a*, 5*b*, 6*a*, & 6*b*) can have identical lengths simplifying assembly and transport.

FIG. 7A through 7E show various embodiments where the legs are formed in alternate ways. Each shows an embodiment of a leg connected at the leg shoulder 63 as shown FIG. 6 (to the T body 69) or FIG. 7A (to the cross bar body 79). These leg embodiments are exemplary and not intended to be restrictive of the invention. These embodiments are lightweight and strong.

FIG. 7A illustrates leg reinforcement 66(*a-e*) consisting of a cylinder with cross hair with horizontal and vertical reinforcements. This embodiment provides the best reinforcement for the respective pipes, but has more material and cost.

Figure 7B:
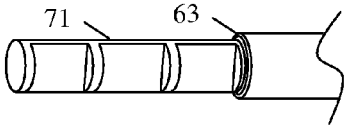

FIG. 7B illustrates a first alternate leg 71 consisting of a vertical bar with thin disks set at intervals. This embodiment helps maintain the round shape of the pipes with less material than the embodiment in 7A. This embodiment provides good linear support in one dimension, as is primarily needed with the cross bar 8.

Figure 7C:
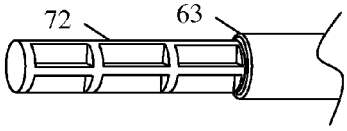

FIG. 7C illustrates a second alternate leg 72 consisting of intersecting bars with thin disks set at intervals. This embodiment helps maintain the round shape of the pipes with less material than the embodiment in 7A. This embodiment provides good linear support in two dimensions.

Figure 7D:
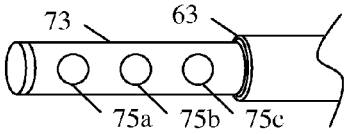

FIG. 7D illustrates a third alternate leg 73 consisting of a vertical bar with circle cutouts 75 hole. This embodiment reduces the material and cost over the other embodiments shown.

Figure 7E:
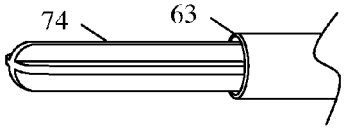

FIG. 7E illustrates a fourth alternate leg 74 comprising vertical and horizontal pieces having a cross hair cross-section.

FIGS. 7A and 7E are examples of embodiments that could be home made. The bodies could be made by cutting PVC pipe and sheets of PVC plastic to form the shapes shown and then melding them into a single piece using PVC cement. The PVC pipe and PVC cement are available at local hardware stores. PVC plastic sheets can be obtained cut to size, from plastic stores or the Internet, e.g. Tap Plastics, www.tapplastics.com.

Caps

Figure 8A:
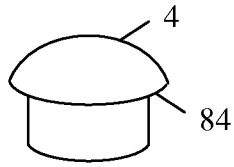
FIG. 8A illustrates the embodiment of a cap.
Figure 8B:
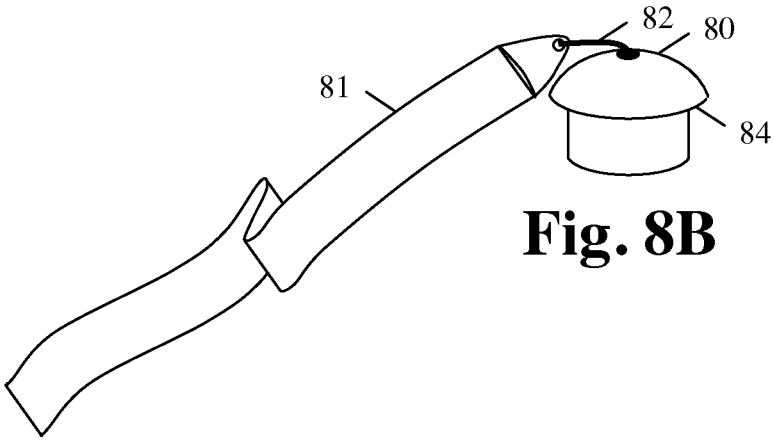
FIG. 8B illustrates the embodiment of a cap with wind streamers.

FIG. 8A shows an embodiment of the cap 4 with the cap shoulder 84 for the present invention. FIG. 8B shows the embodiment of a cap with wind streamer attachment 80 for the present invention. As with the embodiment of cap 4, the cap with wind streamer attachment 80 also has a cap shoulder 84 making both interchangeable. In addition, a provision for a wind streamer 81 is made and is held by a wind streamer attachment 82. The wind streamer attachment 82 is made via a hole in the cap 80 or via a hole in an eye loop molded into the cap 80.

Molded Reinforcements Enabling Same Sized Pipes

As discussed above, a regulation Rugby goal post requires the top of the cross bar to be 3 meters or 9'10" above the ground and to separate the goal posts by 5.6 meters of 18'4". FIG. 9A and FIG. 9B illustrate a currently preferred embodiment that enables the uses of same sized pipes, for example nine feet each.

Figure 9A:
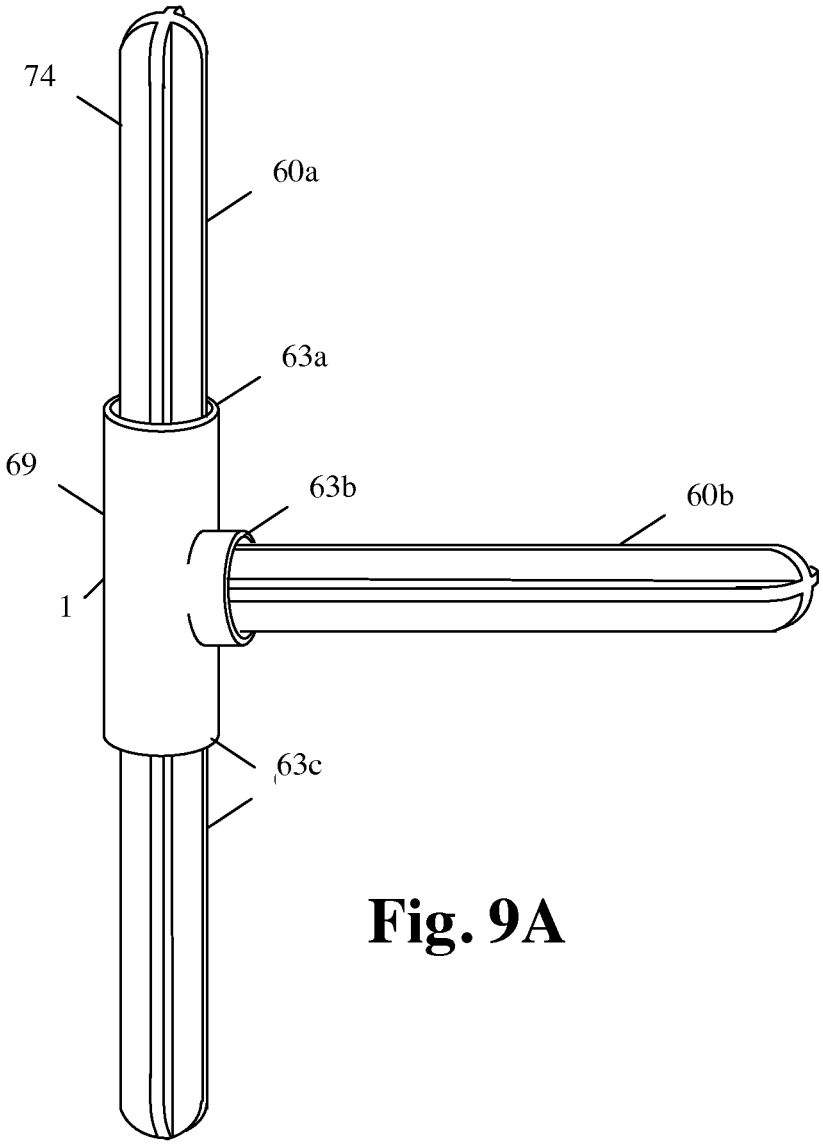
FIG. 9A illustrates a single piece T reinforcement.
Figure 9B:
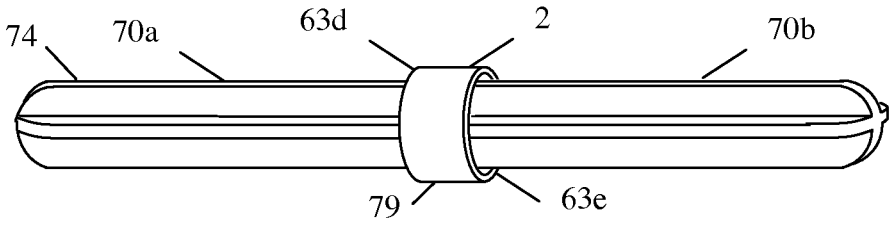
FIG. 9B illustrates a single piece cross bar reinforcement.

Details of the preferred embodiment of molded pieces are shown in FIG. 9A, namely the T reinforcement 1, and in FIG. 9B, namely the cross bar reinforcement 2. The body of each T body 69 and cross bar reinforcement body 79 preferably has the same outer diameter as the PVC pipes including the upper posts 3*a* and 3*b*, lower posts 5*a* and 5*b* and cross bar sections 6*a* and 6*b*. The reinforcement legs 60(*a-c*) and cross bar legs 70(*a-b*) have an outer diameter that fits tightly the inner diameter of the PVC pipes (3*a*, 3*b*, 5*a*, 5*b*, 6*a*, & 6*b*), preferably 2 inches. The T body 69 and the cross bar reinforcement body 79 leg shoulders 63(*a-e*) that match the end of each PVC pipe (3*a*, 3*b*, 5*a*, 5*b*, 6*a*, & 6*b*) when fully inserted (forming a hidden seam) providing the consistent outer diameter for the goal post 11.

FIG. 9A illustrates the preferred embodiment of the T reinforcement 1, comprising a T body 69 and three legs (60*a*, 60*b*, and 60*c*). Where the respective legs connect to the T body 69, the T reinforcement 1 comprises a leg shoulder (63*a*, 63*b*, and 63*c*, respectively). As shown, the fourth alternate leg 74 comprising vertical and horizontal pieces having a cross hair cross-section is preferred. The T body 69 preferably has a T body height of 18 inches between leg shoulders 63*a* and

63*b* and a T body width of 1 inch between leg shoulder 63*b* and its attachment to the T body 69.

FIG. 9B illustrates the preferred embodiment of the cross bar reinforcement 2, comprising a cross bar body 79 and two cross bar legs (70*a*, and 70*b*). Where the respective legs connect to the cross bar body 79, the cross bar reinforcement 2 comprises a leg shoulder (63*d* and 63*e*, respectively). As shown, the fourth alternate leg 74 comprising vertical and horizontal pieces having a cross hair cross-section is preferred. The cross bar body 79 preferably has a cross bar body width of 2 inches between leg shoulders 63*d* and 63*e*.

When assembled with six equal length pipes (3*a*, 3*b*, 5*a*, 5*b*, 6*a*, and 6*b*) as shown in FIG. 5, these preferred reinforcements 1 and 2 result in a regulation size Rugby goal post. The lower post (5*a* or 5*b*) of nine feet when combined with the T body height of eighteen inches will result in the required 3 meter height of the top of the cross bar. In summary, eighteen inches divided by two equals nine inches, plus one inch radius makes a ten inch contribution by the T body reinforcement 1; this ten inches combined with the nine feet of the respective lower posts (5*a* and 5*b*) results in the required nine feet ten inches. Likewise, each T body reinforcement (1*a* and 1*b*) contribute one inch to the distance between the upper posts (3*a* and 3*b*). The cross bar reinforcement 2 contributes two inches to the distance between the upper posts (3*a* and 3*b*). The cross bar sections (6*a* and 6*b*) of nine feet each when combined with the two T body and cross bar body will result in the required 5.6 meter separation of the upper posts (3*a* and 3*b*). In summary, one inch from each T body reinforcement 1*a* and 1*b*, plus 2 inches from the cross bar reinforcement 2, equals 4 inches; this four inches combined with the eighteen feet of the two combined cross bar sections (6*a* and 6*b*) results in the required eighteen feet four inches. The upper posts 3*a* and 3*b* are also nine feet each, resulting in a total post height of eighteen feet, eighteen inches, which is greater than 3.4 meters, which is the required minimum height.

As discussed throughout, the reinforcements 1 and 2 are not merely convention connectors, but have a required function of reinforcing the pipes they connect, in order for the reinforcements 1 and 2, to achieve their reinforcement function, preferably each leg is significantly longer than the respective body. Preferably each leg is at least two feet in length. If, for example, the horizontal legs and cross bar legs (60*b*, 70*a* and 70*b*) are three feet in length, then the two thirds of each cross bar sections (6*a* and 6*b*) would be reinforced. If, for another example, the horizontal legs and cross bar legs (60*b*, 70*a* and 70*b*) are two and one half feet in length, then greater than half of each cross bar sections (6*a* and 6*b*) would be reinforced. If, for yet another example, the horizontal legs and cross bar legs (60*b*, 70*a* and 70*b*) are two feet four inches in length, then each leg would reinforce at least one fourth of each respective cross bar sections (6*a* and 6*b*), and since each cross bar sections (6*a* and 6*b*) is reinforced from each end, at least half of the overall length of the respective cross bar sections (6*a* and 6*b*) would be reinforced. In this embodiment, where all of the posts are nine feet in length the maximum length of the horizontal legs and cross bar legs (60*b*, 70*a* and 70*b*) is four and one half feet each which would result in reinforcement along the entire cross bar, and half of the upright posts (3*a* and 5*a*, and 3*b* and 5*b*).

While these sizes are selected to enable all six of the pipes to be nine feet, it would be within the scope of the invention for each pipe to be, for example, eight feet six inches, in which case, the T body length would have to increase six inches at leg shoulder 63*c* and an additional 12 inches would have to be distributed in the bodies at leg shoulders 63*b*, 63*d* and 63*e*. For example, five inches between leg shoulder 63*b* and the T body attachment, and a cross bar body width of six inches, would result in the required eighteen feet four inches. Thus, using equal sized pipes of less than nine feet would require the respective body heights and widths to be increased.

Minimal Shipping

The invention may be manufactured as a product comprising molded T reinforcements 1 and a cross bar reinforcement 2. Only the single piece reinforcements (1, 2) need to be manufactured and shipped. The caps (4 or 80) could also be included. The user can then obtain the standard PVC pipe (cut to size) and fence posts at a local hardware store. This reduces manufacturing, warehousing and shipping costs, but provides an easy to use, durable, reusable, portable solution.

Advantages

Lightweight

These improved goal posts are lightweight.

Low Cost

These improved goal posts are low cost. They can be made of PVC pipe and or other types of rods, pipes, and tubing that are plastic, metal etc. and which are inexpensive and readily available.

Simple to Make and Manufacture

These improved goal posts are easy to make or to manufacture, having a simpler set of parts and configuration.

Collapsible

These improved goal posts are collapsible for easier handing.

Easy to Store

These improved goals post are easy to store.

Easy to Transport

These improved goal posts are easy to transport. They can fit inside most vans and SUVs, which are commonly available to small sport clubs and families.

Easy to Ship

The molded parts can be shipped easily, compared to having to ship the entire goal posts of convention goal posts.

Easy to Use

These improved goal posts are ideal for people, groups of people, and organizations, such as athletic clubs, schools and churches, who prefer a low maintenance and low cost goal post. Kits can be assembled by the purchaser. Assembly does not require special tools such as wrenches, pliers, and screwdrivers. These improved goal posts made of parts with consistent sizes, which minimize manufacturing and make assembly and disassembly easier.

Professional Appearance

These goal posts have a professional and aesthetic appearance with hidden seams between the components.

Durable

The preferred embodiments of these goal posts are durable and are less likely to be broken.

CONCLUSION, RAMIFICATION, AND SCOPE

Accordingly, the reader will see that the improved lightweight, portable, low cost goal posts are easy to use and transport.

While the above descriptions contain several specifics these should not be construed as limitations on the scope of the invention, but rather as examples of some of the preferred embodiments thereof. Many other variations are possible. For example, the legs of the single piece reinforcements can be manufactured in different ways to reduce material and simplify manufacturing. The variations could be used without departing from the scope and spirit of the novel features of the present invention.

Accordingly, the scope of the invention should be determined not by the illustrated embodiments, but by the appended claims and their legal equivalents.

What is claimed is:

1. A portable goal post consisting of:

a) six pipes of the same predetermined length, wherein predetermined length is less than or equal to nine feet, b) two T reinforcements, each having:

i) a T body, ii) an upper leg, iii) a horizontal leg, and iv) a lower leg, wherein each horizontal leg has a length that is at least one fourth of the predetermined length of the six pipes; and c) a cross bar reinforcement, having i) a cross bar body, and ii) two cross bar legs, wherein each cross bar leg has a length that is at least one fourth of the predetermined length of the six pipes;

wherein any two of the six pipes form upper posts, each removeably connected to the upper leg of one of the T reinforcements respectively, wherein any two of the six pipes form lower posts, each removeably connected to lower leg of one of the T reinforcements respectively, and wherein any two of the six pipes form cross bar sections to form a crossbar, each removeably connected a horizontal leg of the T reinforcements respectively, and both connected to respectively cross bar legs, wherein over half of the distance between upper posts are reinforced by the combination of horizontal legs and the cross bar reinforcement, whereby the portable goal post is assembled using any of the same length pipes, whereby the portable goal post is disassembled and transported using a passenger vehicle.

2. The portable goal post of claim 1, wherein the predetermined length of the six pipes is about nine feet, wherein a shoulder is formed where each T reinforcement leg meets each T body, wherein the T body height is about eighteen inches, wherein the T body width between the horizontal leg shoulder and the T bar attachment is about one inch, wherein the cross bar body width is about two inches, wherein each of the horizontal legs and cross bar legs are at least about two feet in length, and wherein when assembled, the top of the cross bar is about three meters high and the upper posts are separated by about 5.6 meters, whereby the portable goal post is a regulation sized Rugby goal post.

3. The portable goal post of claim 1, wherein each T reinforcement leg consists of a vertical piece and a horizontal piece having a cross hair cross-section.

4. The portable goal post of claim 1, wherein each leg consists of a rectangular bar having a plurality of perpendicular disks spaced at intervals along the bar.

5. A goal post system comprising:

a) two portable goal posts of claim 1, two or more of the group of a goal post cap and a wind streamer, removeably attached to at least one of the portable goal posts.

6. The goal post of claim 1 wherein a shoulder is formed where each leg meets the respective body, wherein the outer diameter of the body is the same as the outer diameter of the attached upper post, lower post, or cross bar section, whereby the seam between the shoulder and the attached post or section is hidden.

7. The goal post of claim 1 wherein each leg has an outer diameter which connects tightly with the inner diameter of the attached upper post, lower post, or cross bar section, wherein the shape of the attached post or section is reinforced, whereby the goal post maintains a predetermined shape.

8. The goal post of claim 7 wherein each leg comprises hollow cylinder having said outer diameter.

9. The goal post of claim 8 where the hollow cylinder is internally reinforced with a plurality of radially intersecting, rectangular sheets of material.

10. The goal post of claim 7 wherein each leg comprises a rectangular bar having a plurality of perpendicular disks spaced at intervals along the bar.

11. The goal post of claim 10 wherein the leg further comprises an intersecting bar providing an addition dimension of support between the disks.

12. The portable goal post of claim 1, wherein the predetermined length of the six pipes is about nine feet, wherein the T body height is about eighteen inches, wherein twice the T body width, between a horizontal leg shoulder and an attachment to a vertical portion of the T body, and the cross bar body width combined is about four inches, wherein each of the horizontal legs and cross bar legs are at least about two feet six inches in length, and wherein when assembled, the top of the cross bar is about three meters high and the upper posts are separated by about 5.6 meters, whereby the assembled portable goal post forms a regulation sized Rugby goal post.

13. The portable goal post of claim 1, wherein a shoulder is formed where each leg meets each T body, wherein the T body height, between the upper leg shoulder and the lower leg shoulder is about eighteen inches, wherein the T body horizontal width, between the horizontal leg shoulder and an attachment to a vertical portion of the T body is about one inch, wherein the horizontal leg is at least three feet in length, wherein the upper leg and the lower leg are each at least two feet in length, wherein each leg is inserted into a respective pipe, each leg reinforcing the respective pipe.

14. A method of assembling the portable goal post of claim 1, the method comprising the steps of:

a) removeably connecting each of the upper posts to the upper leg of one of the T reinforcements respectively, b) removeably connecting each of the lower posts to the lower leg of one of the T reinforcements respectively, c) removeably connecting each of the cross bar sections to one leg of the cross bar reinforcement respectively, d) removeably connecting each of the cross bar sections to the horizontal leg of one of the T reinforcements respectively, wherein each of the legs of the reinforcements help maintain the shape of the post or section into which the respective leg is inserted, whereby the goal post is assembled using lightweight posts and sections.

15. The method of claim 14, further comprising the steps of:

e) driving fence posts into a playing field, f) raising the assembled goal post over the fence posts, wherein one lower post is placed over one of the fence posts and the other lower post is placed over the other fence post, whereby the fence posts hold the goal post erect, g) later, disassembling the goal post for compact storage or transportation.

16. The method of claim 15, further comprising the step of:

h) transporting the disassembled goal post using a passenger vehicle.

* * * * *